United States Patent [19]

Roming

[11] Patent Number: 4,498,463

[45] Date of Patent: Feb. 12, 1985

[54] MASSAGE APPARATUS

[76] Inventor: Helmut Roming, Linberg 27, D-7230 Schramberg 11, Fed. Rep. of Germany

[21] Appl. No.: 339,148

[22] Filed: Jan. 13, 1982

[30] Foreign Application Priority Data

Jan. 20, 1981 [DE] Fed. Rep. of Germany ..... 3101538

[51] Int. Cl.[3] ..... A61H 1/00

[52] U.S. Cl. ..... 128/37; 128/47; 128/66

[58] Field of Search ..... 128/24.3, 37, 47, 51–53, 128/56, 57, 50, 66, 67, 59, 60; D24/41

[56] References Cited

U.S. PATENT DOCUMENTS

| | | | |
|---|---|---|---|
| D. 262,908 | 2/1982 | Pesco | D24/36 |
| D. 273,708 | 5/1984 | Haug | D24/36 |
| 1,038,656 | 9/1912 | Reuter | 128/66 |
| 1,088,242 | 2/1914 | Rudolph | 128/53 |
| 1,101,804 | 6/1914 | Lauter | 128/37 X |
| 2,159,096 | 5/1939 | Mitchell | D24/36 X |
| 2,290,454 | 7/1942 | Steinberg | 128/52 X |
| 2,895,469 | 7/1959 | Regley | D24/36 X |
| 2,905,171 | 9/1959 | De Crescenzo | D24/41 X |
| 3,720,204 | 3/1973 | Wojtowicz | 128/66 |
| 3,994,290 | 11/1976 | Springer et al. | 128/57 |
| 3,998,390 | 12/1976 | Peterson et al. | 128/66 |
| 4,116,233 | 9/1978 | Scaduto | 128/32 |
| 4,274,400 | 6/1981 | Baus | 128/53 |
| 4,326,508 | 4/1982 | Stauffer | 128/57 |

FOREIGN PATENT DOCUMENTS

| | | | |
|---|---|---|---|
| 1143886 | 10/1957 | France | 128/37 |
| 1249098 | 11/1960 | France | 128/57 |

*Primary Examiner*—Richard J. Apley
*Assistant Examiner*—David J. Brown
*Attorney, Agent, or Firm*—Steele, Gould & Fried

[57] ABSTRACT

A water pressure powered massage and spray apparatus includes a casing, a plurality of axially movable massage members projecting from a working surface of the casing to perform the massaging action, a water connection and a drive mechanism including a water turbine to drive the massage members. The massage members are individually held in the casing in such a way that they have a range of free axial movement, but cannot drop out. The water turbine has at least one eccentric projection extending toward the massage members for causing axial movement of the massage members. In their extreme outward position, the massage members substantially close the working surface of the casing, so that spray jets can pass out through spray jet guides provided in the casing, thereby automatically converting the apparatus between use as a massage and use as a spray.

18 Claims, 3 Drawing Figures

MASSAGE APPARATUS

BACKGROUND OF THE INVENTION

The invention relates to a massage apparatus with a casing, at least one axially movable massage member projecting from the working surface of the casing and exercising the massage action, a water connection and a drive mechanism for the massage member which has a water turbine.

Massage apparatus in which in each case a rotary brush ring is driven by means of a water turbine are known e.g. from Offenlegungsschrifts Nos. 26 34 772, 25 05 969 and German Utility Model No. 75 41 260. The problem with said known massage apparatus is that a driving torque exerted on the massage brush is not adequate to effectively rotate the brush, if the brush is driven directly by the turbine, i.e. without any gearing down. Reduction gears have gear wheels in the water flow path and therefore tend to be subject to calcification. In the case of the massage apparatus according to German Utility Model No. 75 41 260 the turbine is provided with an eccentric embraced by a fork radially connected to the rotor brush shaft, so that the rotary movement of the turbine is converted into a reciprocating, periodic oscillating movement, so that only a limited movement is performed by the massage brush. Axial movements of the brush can be superimposed by use of cooperating projections provided on the rotor brush and on the outside of the casing facing said brush. In addition, the known massage apparatus can only be used to a limited extent and as an alternative to a normal spray due to the fact that the working surface taken up by the rotor brush is not available for producing spray jets and for the formation of spray jets a switching-over process is always required.

Apparatus also exist, which are constructed in the manner of a spray head and in which the movement of the massage member is brought about by means of a flexible shaft through the water supply hose and corresponding gears in the spray head. However, such apparatus are complicated and are therefore out of the question for inexpensive mass production.

BRIEF SUMMARY OF THE INVENTION

The object of the invention is to provide a water-drivable massage apparatus with a good mechanical massaging action, which is easy to operate, simply constructed and also usable as a hand-held spray.

According to the invention this object is achieved in that a plurality of massage members is provided, the massage members being individually held in the casing with an axial clearance and in drop-out-proof manner, and on the side of the water turbine facing the massage members the water turbine has at least one eccentric projection for producing the axial movement.

Unlike the rotary brushes of the known massage apparatus, the massage members of the apparatus according to the invention are substantially exclusively axially moved or driven. Thus, the massage movement consists of a jolting or vibrating movement of the massage members in the direction of the part of the body to be massaged. Therefore the massage members are not generally constructed as brushes and instead preferably have a closed and in particular rounded surface. As the massage movement takes place in a pressing rather than a rubbing manner, there are no friction losses, so that the driving force of the turbine can be fully utilized for the massage movement. The turbine is conventionally and preferably a Pelton turbine.

The projection or projections on the turbine can directly cooperate with the massage members whilst producing the axial movement and this particularly applies if the projections are in the form of radial shafts or ribs. However, according to a preferred embodiment of the invention between the water turbine and the massage members a plate is provided for transmitting and in particular gearing up the axial movement produced by the eccentric projection and its surface boundaries are essentially the surface covered by the massage members. As a result it is possible to keep the eccentricity of the projection on the turbine side relatively small, whilst the working surface fully occupied by the massage members can be covered by the transmission plate.

The axial movement of the individual massage members arranged about the turbine axis is out of phase due to the circular movement of the eccentric projection on the turbine, which means that during the massage process only individual massage members, for example balls, are pressed in rapid time sequence in the direction of the body to be massaged. Therefore the masses moved in each case are low, which again permits increased utilization of the driving force. In addition, the axial displacement of the massage member or members located further from the turbine axis is preferably made higher than that of the massage member or members located closer to the axis. This makes it possible to vary the massage action by the selective application of the more central massage member or members or the member or members located further towards the outside.

According to a preferred embodiment of the invention the axial clearance of the massage members is dimensioned in such a way that engagement between the massage members and the drive only takes place when the massage members are moved inwards toward the turbine from their extreme outward position, most remote from the turbine. This means that the turbine or drive essentially idles if the massage members are in their outward position. However, if the massage apparatus is pressed against the part of the body to be massaged, the massage members are moved inward from their end position and engaged by the drive. The stroke of the axial movement of the massage members increases in proportion of the extent to which they are raised from their end position on pressing against the part of the body to be massaged. The stroke of the axial movement exerted by the massage members is preferably in the range 2 to 10 and most advantageously 4 to 7 mm.

The massage members are preferably also constructed as valve bodies which, in their end position remote from the turbine, substantially tightly close the associated openings in the casing. As a result the water consumption by closing the openings serving as water outlets is greatly restricted if the massage apparatus is raised from the body to be massaged and water pressure forces the massage members into their end position. It is particularly advantageous for the massage apparatus to have additional orifices in the vicinity of the working surface and such orifices are preferably constructed as guides for spray jets at least partly provided in the area of the openings for the massage members. As a result of these additional orifices a pressure relief is obtained within the massage apparatus and the massage members from their end position. Moreover, an automatic switch-over of the apparatus from the massage function to a spray function results. The switch-over is made possible in a particularly advantageous manner if because the apparatus is simply raised from the part of the body to be massaged, then the openings for the massage bodies are closed due to the lack of a counterpressure on the massage bodies. Thus, there is no need for separate switching processes, as are required in the case of known massage apparatus which can be used as sprays.

The transmission plate is preferably rotatable in the casing and has on its side facing the massage members a smooth surface. Due to the rotatability of the transmission plate, friction can be kept to a minimum on converting the rotary movement of the turbine into the axial movement of the massage members. The massage members are in any case mounted in a fixed manner in the casing, apart from their axial clearance. Friction can be further reduced in that the massage members are so constructed and mounted that they can freely rotate individually, particularly about radial axes perpendicular to the turbine axis. This is particularly the case if the massage members are constructed in a cylindrical and preferably spherical manner.

The projection on the water turbine directed towards the massage members can be constructed as a surface inclined towards the rotary plane of the turbine. This surface preferably drops from its highest point in the direction of the turbine axis and can be constructed as a sloping ring coaxial to the turbine axis. The transmission plate can also have at least one eccentrically arranged cam directed towards the water turbine and movable along a circular path on the sloping plane, this being advantageous if the transmission plate is rotatable. As a result of the double eccentricity of the cooperating projections on the transmission plate and turbine, the transmission plate can perform a varying movement dependent on the contact pressure of the massage apparatus, particularly if it is positioned freely in the casing. Due to movement of the transmission plate, the axial movement of the individual massage members and the particular phase of the axial movement is largely independent of the rotary position of the turbine wheel. Direct dependence occurs if, as is the case in another embodiment, only the turbine has an eccentric projection and the side of the plate facing the turbine is flat and in particular planar. It is particularly advantageous if the drive of the massage member according to the invention is free from form-locked transmission means, as is the case in the above described embodiments. If, in addition, said transmission means are disengaged when the massage members are in the end position remote from the turbine, then the pressure loss in the apparatus when it is operating as a spray is extremely low because the turbine idles freely and as a result the spraying pattern of the spray is not impaired.

The massage apparatus casing is appropriately substantially cylindrical and preferably the diameter of the working surface occupied by the massage members substantially corresponds to the turbine diameter. The water connection can issue radially and/or axially into the casing. In the case of a preferred embodiment the casing is provided with a handle on its side directed away from the working surface and said handle can be connected for free rotary movement with respect to the casing. On the side of the casing directed away from the working surface it is also possible to provide a rotatable cover to which is fixed a handle. The handle is appropriately constructed as a bow-shaped handle, the width and height of the bow being such that a flat hand can be inserted between the bow and the cover for gripping the casing. As a result of the rotatability of the handle relative to the casing, the water supply hose does not impede the mobility of the massage apparatus.

BRIEF DESCRIPTION OF THE DRAWINGS

The invention is described in greater detail hereinafter relative to non-limitative embodiments and the attached drawings, wherein.

DETAILED DESCRIPTION OF THE PREFERRED EMBODIMENTS

Figure 1:
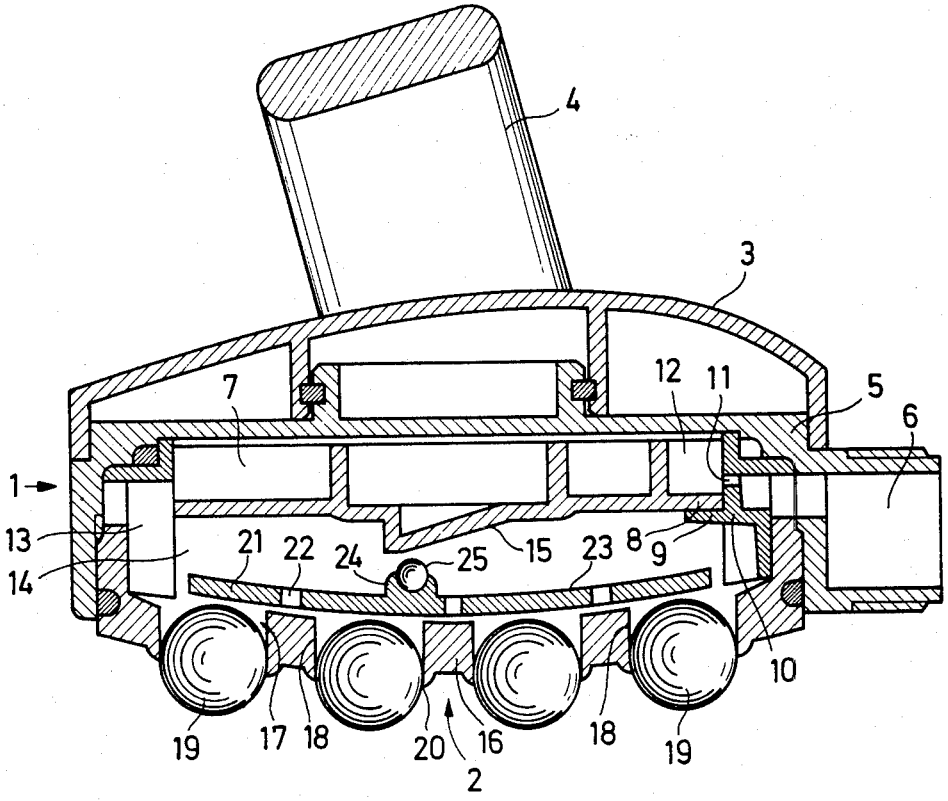
FIG. 1 is a section through an embodiment of the invention.
Figure 2:
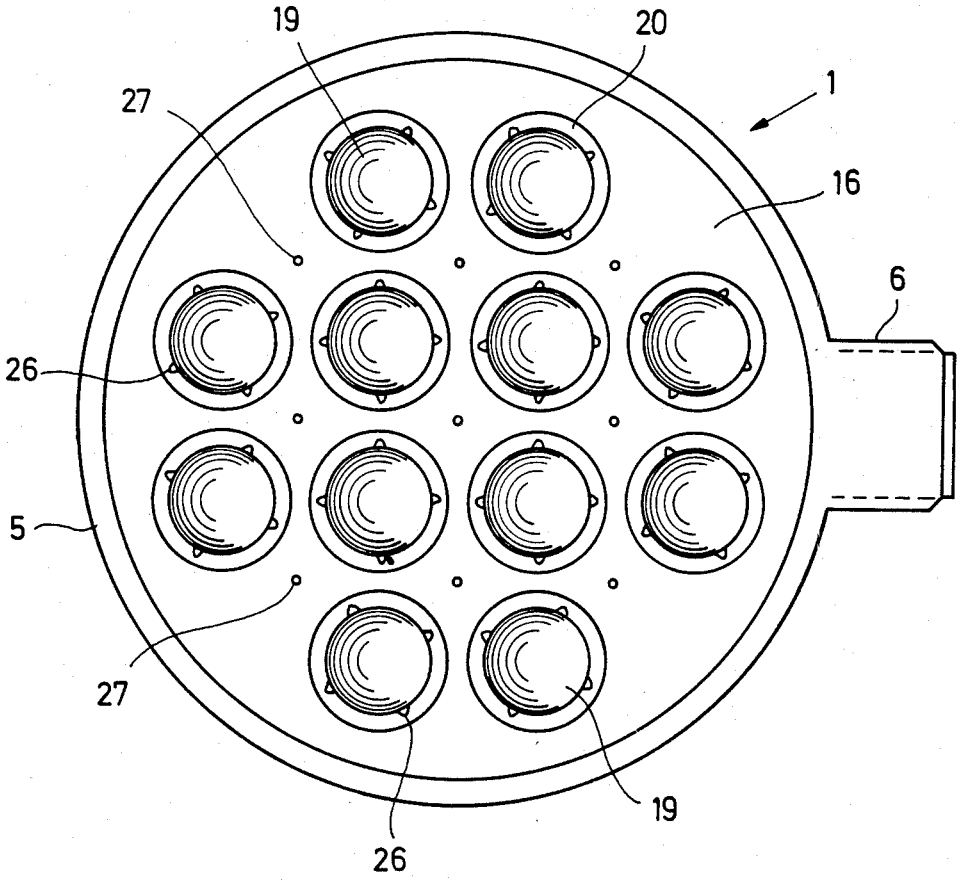
FIG. 2 is a bottom plan view of this embodiment.
Figure 3:
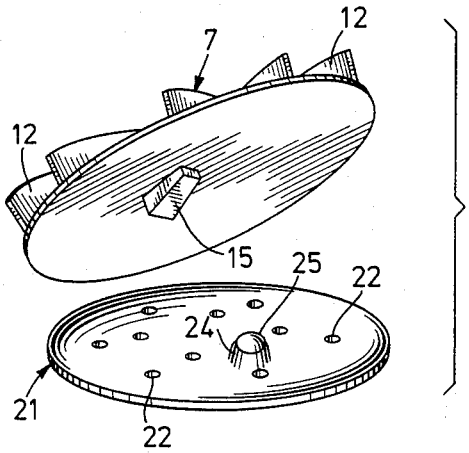
FIG. 3 is a partial exploded perspective view of the embodiment of FIG. 1.

In the embodiment shown in the drawing the massage apparatus has a substantially flat cylindrical casing 1 having on one side a working surface 2 and on the opposite side a cap-shaped handle casing 3. The handle casing is rotatably connected to the apparatus casing 1 by a circular clip and has a flat bow-shaped handle 4, which is constructed so as to permit the insertion of a user's open hand.

The part of the apparatus casing 1 connected to the handle casing 3 is shaped as a dome-shaped turbine casing 5 closed on the handle side and provided with a radial water feed connection 6 having a standard thread. A Pelton turbine 7 open towards the handle side and closed towards working surface 2 is mounted in overhung manner in turbine casing 5 and is supported with its outer edge 8 directed towards working surface 2 on three bearing surfaces 9 (only one is shown) of a feed member 10 inserted in turbine casing 5. Between feed member 10 and turbine casing 5 is an annular channel 11, which communicates with feed connection 6 and from which channel lead three bores 11 for supplying water to turbine blades 12. The water outlet from the turbine blades 12 takes place by means of recesses 13 in feed member 10 in an area 14 of casing 1 located between turbine 7 and working surface 2. Into said area 14 projects an eccentric projection 15 of turbine 7, which is constructed as an axial, central cylinder end with a chamfered end face. The eccentricity of projection 15 is approximately (1/5) to (1/6) of the turbine radius and the slope of the surface, which here substantially corresponds to the height of projection 15, is approximately 1/10 of the turbine radius.

The working surface 2 of the massage apparatus is formed by a base plate 16, which has ten openings 17 with tubular guides 18 for balls 19 serving as massage members and which are located with an axial clearance in guides 18. The edges 20 of openings 17 project somewhat beyond working surface 2 and are slightly narrower than the diameter of guides 18, so that the balls 19 cannot drop out of guides 18 in their end position. At their end position, the balls 19 substantially close openings 17.

An axially freely movable transmission plate 21 having a flat underside rests on the inside of base plate 16, engages over all the balls 19 or ball guides 18 and has water passage openings 22. On its inside surface 23 facing turbine 7, the transmission plate 21 has an eccentric projection 24, whose eccentricity substantially corresponds to that of the chamfered cylinder end 15. A steel ball 25 is rotatably mounted in the front end of projection 24 to reduce friction. The height of projection 24 approximately corresponds to the height of the chamfer of cylinder end 15 of turbine 7. The internal axial height of area 14, i.e. the distance between turbine 7 and transmission plate 21, is such that the two projections 15 and 24 do not engage with one another in the case of a transmission plate 21 resting on guides 18. Engagement only takes place if transmission plate 21 is raised by one or more of the balls 19 due to contact pressure against the massage apparatus. The interaction between the two projections 15 and 24 increases in proportion to the extent that the transmission plate is raised again by the balls following the pressing down caused by the inclined surface. When reciprocal engagement occurs, ball 25 of projection 24 partly or wholly slides along a circular path on the inclined surface of projection 15 transmission plate performs a tumbling movement causing axial back-pressure on balls 19, on which axial pressure is superimposed a rotary variation due to rotation of transmission plate 21 and turbine 7. The speed of transmission plate 21 is significantly lower than that of turbine 7, because transmission plate 21 is merely rotated by the sliding friction between the two projections 15 and 24.

In the case of limited contact pressure the balls 19 are only slightly raised from their inoperative or end position and are forced back by turbine 7 via the inclined surface of projection 15 and transmission plate 21. This only leads to a limited deceleration of turbine 7 and there is a high pulsation frequency for each individual ball. In the case of a higher contact pressure, there is a greater lifting action, the turbine 7 becomes slower due to the higher resistance and an intensive massaging effect is obtained with a lower pulsation frequency, but a very definite massaging action. Due to the limited gradient of the inclined surface of projection 5 and the limited friction radius of the circular path of steel ball 25 on the inclined surface, the transmission losses are kept very low. Furthermore, the overhung mounting of transmission plate 21 ensures that it is not possible to block rotation of turbine 7 by a too high contact pressure on one side. Due to the free adjustability of transmission plate 21 in area 14 the massage effect is transmitted approximately uniformly to all the massaging balls.

The water flowing into area 14 flows through the water outlets 22 into the ball guides 18 which, on their insides, can be provided with spray jet guidance grooves 26 cooperating with balls 19 and then past the balls and through the openings 17 in base plate 16. Base plate 16 also has jet-forming bores 27 through which the water passes out as a spray jet, particularly when the openings 17 are closed by the balls. In this position the turbine idles and produces no pressure loss, so that the spray jets can pass out in conventional manner. As a result of the slight curvature of base plate 16 of the massage apparatus, the operation of the latter is facilitated.

What is claimed is:

1. A massage apparatus comprising:

a casing having a water turbine therein, the turbine being rotatable about an axis, the casing having means for attachment to a supply of water, the casing having a working surface and the working surface having a plurality of openings therein arranged laterally around said axis;

a drive mechanism within the casing, the drive mechanism rotating the water turbine by water supplied to the casing, the turbine having at least one eccentric projection directed toward the working surface;

a movable transmission plate between the water turbine and the working surface for transmitting an axial movement produced by the eccentric projection; and, a plurality of massage bodies movably mounted at the openings in the working surface and arranged around the axis defined by rotation of the turbine, the massage bodies being individually axially movable over an axial stroke between an extreme outward position at which the bodies are captive in the casing and located beyond the transmission plate, and a range of inward positions through which the bodies are moved under influence of the transmission plate.

2. A massage apparatus according to claim 1, wherein the working surface has water outlets located at the openings in the working surface holding the massage bodies, the water outlets being defined by a space between the massage bodies and the casing when the massage bodies are at the extreme outward position.

3. A massage apparatus according to claim 1, wherein the eccentric projection directly cooperates with the massage members to produce the axial movement.

4. A massage apparatus according to claim 1, wherein the axial stroke of the massage members is 2 to 20 and preferably 4 to 7 mm.

5. A massage apparatus according to claim 1, wherein the massage members are constructed as valve bodies, the massage members substantially tightly sealing their respective openings in the working surface of the casing when at the extreme outward position remote from the turbine.

6. A massage apparatus according to claim 1, wherein the working surface of the massage apparatus has jet-forming bores through which water passes out of the casing.

7. A massage apparatus according to claim 1, wherein the side of the transmission plate facing the massage members is smooth at least at portions of the plate coming into contact with the massage members.

8. A massage apparatus according to claim 1, wherein the transmission plate is disk-shaped and is rotatable in the casing.

9. A massage apparatus according to claim 1, wherein the individual massage members are mounted in the casing so as to be freely individually rotatable.

10. A massage apparatus according to claim 1, wherein the massage members are spherical.

11. A massage apparatus according to claim 1, wherein the water turbine projection is constructed as a surface on the turbine inclined towards the rotation plane of the turbine, the projection sloping down from a highest point towards the turbine area.

12. A massage apparatus according to claim 1, wherein the transmission plate has at least one projection directed towards the water turbine and in particular a projection movable on a circular path along the inclined surface thereof.

13. A massage apparatus according to claim 1, wherein only the turbine has an eccentric projection and the side of the transmission plate facing the turbine is substantially planar.

14. A massage apparatus accordingly to claim 1, wherein the drive mechanism and the massage members are at most frictionally engageable.

15. A massage apparatus according to claim 1, wherein the casing is substantially cylindrical, the diameter of the working surface preferably corresponding substantially to the diameter of the turbine.

16. A massage apparatus according to claim 1, wherein on its side directed away from the working surface the casing is provided with a handle, which is rotatably connected with the casing.

17. A massage apparatus according to claim 1, wherein on the side directed away from the working surface the casing has a cover connected in rotary manner with the casing and which is preferably fixed to a handle.

18. A massage apparatus according to claim 17, wherein the cover handle has a bow-shaped construction, the handle and cover defining a space between said handle and the cover which permits the insertion of an open hand.

* * * * *

UNITED STATES PATENT AND TRADEMARK OFFICE

CERTIFICATE OF CORRECTION

PATENT NO. : 4,498,463

DATED : February 12, 1985

INVENTOR(S) : Helmut Roming

It is certified that error appears in the above-identified patent and that said Letters Patent is hereby corrected as shown below:

Column 3, line 3, delete "if because" and insert therefor --because if--.

Column 5, line 17, after "15" insert --. The--.

Signed and Sealed this

*Fourth* Day of *March 1986*

[SEAL]

*Attest:*

DONALD J. QUIGG

*Attesting Officer*

*Commissioner of Patents and Trademarks*